US010448720B2

(12) United States Patent
Schapiro

(10) Patent No.: US 10,448,720 B2
(45) Date of Patent: Oct. 22, 2019

(54) CONVERTIBLE COUNTER/DRY CLEANING BAG WITH IMPROVED ACCESS

(71) Applicant: CLEANER'S SUPPLY, INC., Conklin, NY (US)

(72) Inventor: Jeffrey Schapiro, Conklin, NY (US)

(73) Assignee: CLEANER'S SUPPLY, INC., Conklin, NY (US)

( * ) Notice: Subject to any disclaimer, the term of this patent is extended or adjusted under 35 U.S.C. 154(b) by 733 days.

(21) Appl. No.: 14/933,609

(22) Filed: Nov. 5, 2015

(65) Prior Publication Data

US 2016/0367000 A1 Dec. 22, 2016

Related U.S. Application Data

(60) Provisional application No. 62/180,429, filed on Jun. 16, 2015.

(51) Int. Cl.

| | |
|---|---|
| ***A45C 7/00*** | (2006.01) |
| ***A45C 13/10*** | (2006.01) |
| ***A47G 25/54*** | (2006.01) |

(52) U.S. Cl.

CPC ..... *A45C 13/1046* (2013.01); *A47G 25/54* (2013.01); *A45C 13/103* (2013.01)

(58) Field of Classification Search

CPC ..... A45C 13/1046; A45C 3/004; A45C 25/54; A45C 7/00; A45C 13/103

See application file for complete search history.

(56) References Cited

U.S. PATENT DOCUMENTS

| | | | | |
|---|---|---|---|---|
| 2,378,665 A * | 6/1945 | Threeton | A47G 25/54 | 206/286 |
| 2,469,700 A * | 5/1949 | Petroceill | A41B 13/06 | 2/69.5 |
| 2,781,811 A * | 2/1957 | Dilar | A47G 33/045 | 206/423 |
| 2,897,863 A * | 8/1959 | Somers, Jr. | A45C 9/00 | 383/103 |
| 3,115,959 A | 12/1963 | Jaffe | | |
| 3,831,740 A | 8/1974 | Pendergast et al. | | |
| 4,114,667 A * | 9/1978 | Belson | A45C 11/38 | 224/613 |
| 4,502,576 A | 3/1985 | Reardon | | |
| 4,542,824 A | 9/1985 | Allen | | |
| 5,090,559 A | 2/1992 | Gendreau | | |

(Continued)

*Primary Examiner* — Tri M Mai

(74) *Attorney, Agent, or Firm* — Epstein Drangel LLP; Robert L. Epstein

(57) ABSTRACT

The bag has a garment receiving entrance and a side preferably including a side gusset. An opening in the side extends from a point on the bag to the garment receiving entrance. A drawstring extends around the bag at the garment receiving entrance, except at a location aligned with the side opening. A zipper is movable along the opening in the side between a closed position, wherein the side opening is closed, and an open position, wherein the side opening and the garment receiving entrance combine to form a single large opening to facilitate the insertion and removal of garments into and out of the bag. The bag functions as a counter bag in one orientation and a dry cleaning carrier in a second orientation. In the second orientation, a hanger is situated in the bag with the hanger hook extending through a small opening at the top.

8 Claims, 5 Drawing Sheets

(56) References Cited

U.S. PATENT DOCUMENTS

| | | | | | |
|---|---|---|---|---|---|
| 5,458,278 | A * | 10/1995 | LaConte | A45C 13/103 | 224/153 |
| 6,018,830 | A * | 2/2000 | Howe | A47G 9/086 | 2/69.5 |
| 6,421,834 | B2 * | 7/2002 | Kester | A41D 15/04 | 2/94 |
| 7,703,218 | B2 * | 4/2010 | Burgess | A43B 5/0419 | 36/50.1 |
| 8,235,206 | B2 | 8/2012 | Siegel et al. | | |
| 8,348,054 | B2 * | 1/2013 | Dragan | A45C 13/03 | 206/287 |
| 9,060,553 | B2 * | 6/2015 | Crye | A41D 3/00 | |
| 9,375,037 | B1 * | 6/2016 | Clark | A41D 15/00 | |
| 2003/0051286 | A1 * | 3/2003 | Gregg | A41D 27/10 | 2/93 |
| 2007/0136946 | A1 * | 6/2007 | Haislip | A47G 9/086 | 5/413 R |
| 2010/0006459 | A1 | 1/2010 | Foley | | |
| 2010/0107300 | A1 * | 5/2010 | Yiu | A41D 15/00 | 2/85 |
| 2010/0170818 | A1 * | 7/2010 | Lin | A01G 13/0237 | 206/423 |
| 2010/0320241 | A1 * | 12/2010 | Thompson | A41D 15/04 | 224/153 |
| 2011/0000803 | A1 | 1/2011 | Schapiro | | |
| 2011/0168584 | A1 * | 7/2011 | Torrellas | A45C 3/004 | 206/287 |
| 2012/0241484 | A1 | 9/2012 | Siegel et al. | | |
| 2014/0366239 | A1 * | 12/2014 | Biller | A41D 3/00 | 2/69.5 |
| 2016/0097549 | A1 * | 4/2016 | McMahon | F24F 1/58 | 150/154 |

* cited by examiner

CONVERTIBLE COUNTER/DRY CLEANING BAG WITH IMPROVED ACCESS

CROSS-REFERENCE TO RELATED APPLICATIONS

Priority is claimed on Provisional Patent Application No. 62/180,429, filed Jun. 16, 2015, the contents of which are incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to bags for use in the laundry and dry cleaning industry for holding and transporting articles of clothing and more particularly to a convertible counter/dry cleaning bag for holding laundry and transporting dry cleaning having a side gusset with a zipper and a garment receiving entrance with a drawstring, wherein moving the zipper to the open position causes the side gusset to open and combine with the garment receiving entrance to form a single large opening to facilitate the insertion and removal of garments into and out of the bag.

2. Description of Prior Art Including Information Disclosed Under 37 CFR 1.97 and 1.98

Dry cleaning establishments often provide the service of collecting soiled garments from customers and returning the garments to the customers after they are processed by the dry cleaner, Those establishments commonly provide the customer with a large fabric bag, known as a counter bag, in which the customer places the garments that require processing by the dry cleaner.

The dry cleaner picks up the counter bag with the soiled garments from the customer and brings it back to the establishment where the garments ace removed from the bag and processed. After the garments are processed, the dry cleaner bangs the processed garments on a hanger and places a thin transparent disposable plastic bag over the processed garments for protection during transport back to the customer.

A conventional counter bag has a wide garment receiving entrance to permit the garments to be easily inserted into and removed from the bag. A drawstring encircles the bag proximate the opening. The drawstring is provided to close the entrance of the bag during transport so that the garments cannot accidentally fall out of the bag and become soiled, lost or damaged.

The drawstring is commonly held in place within a channel proximate to and surrounding the garment entrance of the bag. The channel may be formed by folding the fabric of the bag over and sewing the free end of the fold to the body of the bag. The channel is interrupted at one point so a portion of the drawstring can extend outside the channel and be grasped by the user. That enables the user to pull the exposed portion of the drawstring in a direction away from the bag to close the entrance.

Garment bags are known in the art. A garment bag is a fabric bag that is large enough and shaped appropriately to at least partially cover one or more garments supported on a hanger. The garment bag has a small opening at the top through which the hook portion of the hanger extends, when the hanging garments are placed in the bag, it may have an open or a closed bottom.

A conventional garment bag often has an opening with a zipper extending along a substantial portion of its length. The opening permits the hanging garments to be inserted into and removed from the bag. Once the garments are inside, the garment bag the zipper is used to close the opening so that the processed garments are protected.

A garment bag could be used by the dry cleaner to protect processed garments as they are transported back to a customer, instead of the conventional disposable plastic bags. A garment bag would offer greater protection for the processed garments than the disposable plastic bags. Moreover, the use of a garment bag in that manner would be ecologically friendly as it would eliminate the use of many disposable plastic bags.

However, fabric garment bags are much too expensive for a single use. Further, they would have to be collected from the customer by the dry cleaner for reuse after the customer has removed the garments, That would mean many extra trips by the dry cleaner to the customer which would waste fuel, lead to more vehicle maintenance and require additional labor.

Accordingly, a single garment carrier has been developed to function both as a counter bag and as a garment bag. That carrier can be used to transport garments from the customer to the dry cleaner for processing and also to return the processed garments to the customer from the dry cleaner. Thus, the single carrier serves both purposes. Further, it is ecologically friendly in that it eliminates the use of disposable plastic bags and at the same time does not require a separate trip by the dry cleaner to retrieve the bag from the customer after the processed garments are removed.

The carrier can function as a counter bag, when used in a first orientation, and as a garment bag, designed for use with a hanger with a hook portion, when used in a second orientation. Some convertible carriers consist of a flexible fabric bag-like main section and an extendible section. The main section has a large garment receiving opening at one end and a small hanger hook portion receiving opening at the other end. The extendible section extends from the portion of the main section proximate the garment receiving entrance and is movable between a position within the main section, when the carrier functions as a counter bag, and a position outside the main section, to extend the main section to more protect the processed garments, when the carrier functions as a garment bag.

One such convertible carrier is disclosed in Patent Application Publication No. 2010/0006459 to Foley. That application discloses a reusable cleaning bag having a dual purpose as a hanging garment cover and a tote bag.

When the Foley convertible bag is used as a counter bag, a drawstring situated proximate the entrance of the main section is used to close the bag. The drawstring surrounds the carrier and functions in a conventional manner to close the opening of the main section when the drawstring is drawn away for the bag.

In one orientation, with extendible section situated within the main section and the garment receiving entrance located at the top, the carrier functions as a counter bag. Soiled garments are placed into the main section through the opening and the drawstring is used to close the opening during transport to the dry cleaner.

In a second orientation, with the extendible section situated outside of the main section and the hanger hook receiving opening located at the top, the carrier functions as a garment bag. The processed garments are placed on one or more hangers. The carrier is then placed over the hanging garments and the hook portion of each hanger is received through the small hanger hook opening at the top. In this way, the processed garments are protected as they are transported by the dry cleaner back to the customer.

After the customer receives the processed garments, the garments are removed from the carrier, the extendible section is folded back into the main section, and the orientation of the carrier is reversed so that the garment receiving entrance is located at the top. The customer puts the next batch of soiled garments into the carrier and it is once again ready for pick up by the dry cleaner.

The above described carrier works well as a two way carrier for the customer as well as for the dry cleaner. However, it is sometimes difficult to get the garments in and out of the carrier when the carrier functions as a garment bag. The dry cleaner must insert the processed garments into the carrier. The customer must remove the processed garments from the carrier. However, unlike many conventional garment bags, the convertible carrier has no opening along the front or side to facilitate access to the interior of the carrier. Incorporating such an opening into the carrier is not possible in the conventional convertible carrier because the front or side opening, in order to be long enough to facilitate garment insertion and removal, would intersect the plane of the drawstring. Hence, the front or side opening would interfere with the function of the drawstring because to function properly, the drawstring must encircle the entire bag proximate the garment receiving entrance.

In order to address that problem, the bag disclosed in my patent application published as Pub. No. 2011/0000803 was invented. That garment carrier is convertible to function as a counter bag, in a first orientation, and a garment bag for use with a hanger with a hook, in a second orientation. The main section of the carrier includes a relatively large garment receiving entrance at one end and a relatively small hanger hook receiving opening at the other end.

An opening with a zipper is provided to permit insertion and removal of garments. A drawstring is provided for closing the garment receiving entrance of the main section. The opening is situated on the front wall of the carrier and intersects the plane of the drawstring, which includes first and second separate drawstring sections. Each of the drawstring sections has an end anchored to the main section. The anchor points of the drawstring sections are at respective points on opposite sides of the opening, such that the opening does not interfere with the operation of the drawstrings. The carrier has an extendable section which depends from the main section and is movable between a position within the main section, when the carrier functions as a counter bag, and a position outside the main section, when the carrier functions as a garment bag.

The opening in the front wall of the bag extends along the main section and partially along the extended section, but ends at a point spaced from the garment receiving entrance at the end of extended section. Processed garments from the dry cleaner are inserted into the bag and removed from the bag through the opening. This configuration improves access to the interior of the bag as compared to prior convertible bags but insertion and removal of garments from the bag can still be difficult because the front opening does not open the extended portion of the bag completely.

It is known to incorporate side gussets in garment bags in order to increase the size of the interior of the bag and permit a greater number of garments to be contained in the bag. It is also known to place the opening for the zipper at the side of the bag, see U.S. Pat. No. 8,235,206 and U.S. Patent Publication No. 20120241484. However, in no laundry or dry cleaning bag having a drawstring which closes the garment receiving entrance does the zipper opening extend to the opening at the end of the extended portion. Thus, even when the zipper is moved to its open position, there is limited access to the interior of the bag and the insertion and removal of garments into and out of the bag can be difficult.

BRIEF SUMMARY OF THE INVENTION

It is, therefore, a prime object of the present invention to provide a convertible counter/dry cleaning bag which allows easy access to the interior of the bag.

It is another object of the present invention to provide a convertible counter/dry cleaning bag having an opening which extends to the garment receiving entrance.

It is another object of the present invention to provide a convertible counter/dry cleaning bag having a side gusset with an opening and a garment receiving entrance closeable by a drawstring.

It is another object of the present invention to provide a convertible counter/dry cleaning bag in which the side gusset opening extends through the plane of the drawstring to the garment receiving entrance.

It is another object of the present invention to provide a convertible counter/dry cleaning bag in which moving the zipper to the open position combines the opening in the side gusset and the garment receiving entrance into a single large opening.

It is another object of the present invention to provide a convertible counter/dry cleaning bag in which the exposed portion of the drawstring is located proximate adjacent the garment receiving entrance at a point opposite the point where the side gusset opening meets the garment receiving entrance.

The above objects are achieved by the present invention which relates to a convertible counter/dry cleaning bag including a body with a garment receiving entrance and a side gusset. An opening in the side gusset is defined by first and second edges extending from the upper portion of the side gusset to the garment receiving entrance. A drawstring extends from a location proximate the first side gusset edge to a location proximate the second side gusset edge around the garment receiving entrance. A zipper is movable along the side gusset opening between a closed position wherein the side gusset opening is closed and an open position wherein the side gusset opening and the garment receiving entrance combine to form a single large opening to facilitate the insertion and removal of garments in and out of the body.

The side gusset includes first and second side gusset portions located on opposite sides of the zipper opening. The drawstring includes first and second string ends, each fixed to a different one of the side gusset portions.

The bag has a channel through which the drawstring extends. The channel includes first and second closed ends. The closed channel ends terminate proximate different edges of the side gusset opening. The ends of the drawstring are fixed to different ones of the closed channel ends.

The bag includes a substantially closed end opposite the garment receiving entrance. A hanger hook receiving opening is situated in the substantially closed body end. When used as a dry cleaning bag, a hanger is situated in the bag with the hook of the hanger extending through the hanger hook receiving opening.

The bag functions as a laundry bag in a first orientation and a dry cleaning transport bag in a second orientation.

In accordance with another aspect of the present invention, a convertible counter/dry cleaning bag is provided. The bag includes a relatively large garment receiving entrance at one end and a relatively small opening at an opposite end. The bag has a side. An opening in the side is defined by first and second side opening edges. The side opening extends from a point on the bag proximate the small opening toward the large entrance. A drawstring surrounds the large entrance except at a point aligned with the side opening. A zipper is movable along the side opening between a closed position, wherein the side opening is closed, and an open position, wherein the side opening and the garment receiving entrance combine to form a single large opening to facilitate the insertion and removal of garments into and out of the bag.

The side includes first and second side portions located on opposite sides of the side opening. The drawstring has first and second drawstring ends fixed to different ones of the side portions.

The bag includes a channel through which the drawstring extends. The channel includes first and second closed ends. The closed channel ends terminate proximate different edges of the side opening. The ends of the drawstring are fixed to different ones of the closed channel ends.

The bag body functions as a laundry bag in a first orientation and a dry cleaning transport carrier in a second orientation.

The drawstring includes first and second drawstring portions. Each of the drawstring portions has an exposed portion and a fixed end.

BRIEF DESCRIPTION OF THE SEVERAL VIEWS OF DRAWINGS

To these and to such other objects that may hereinafter appears, the present invention relates to a convertible counter/dry cleaning bag as described in detail in the following specification and recited in the annexed claims, taken together with the accompanying drawings, in which like numerals refer to like parts and in which:

Figure 2:
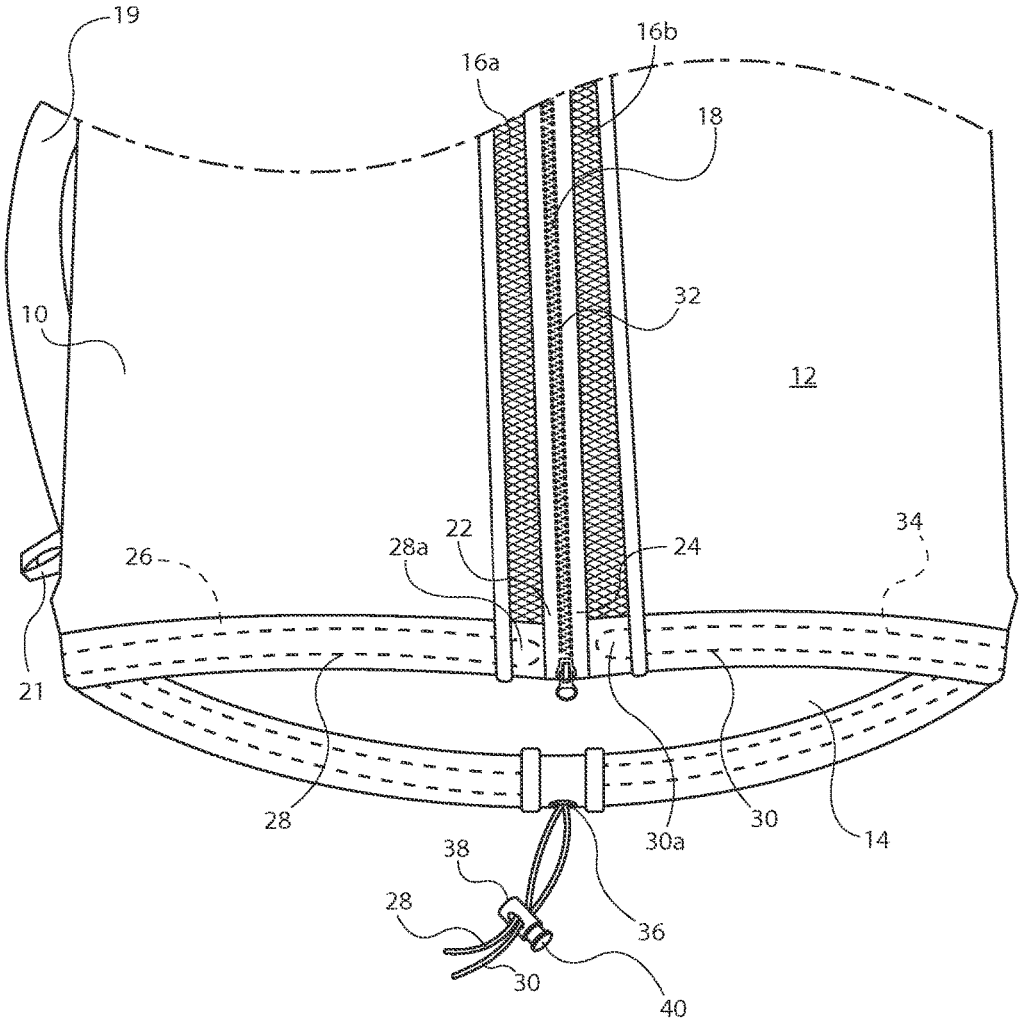
FIG. 2 is a side view of the lower portion of the bag of FIG. 1 showing the details of the garment receiving entrance, drawstring, side gusset and zipper, with the zipper in the closed position.
Figure 4:
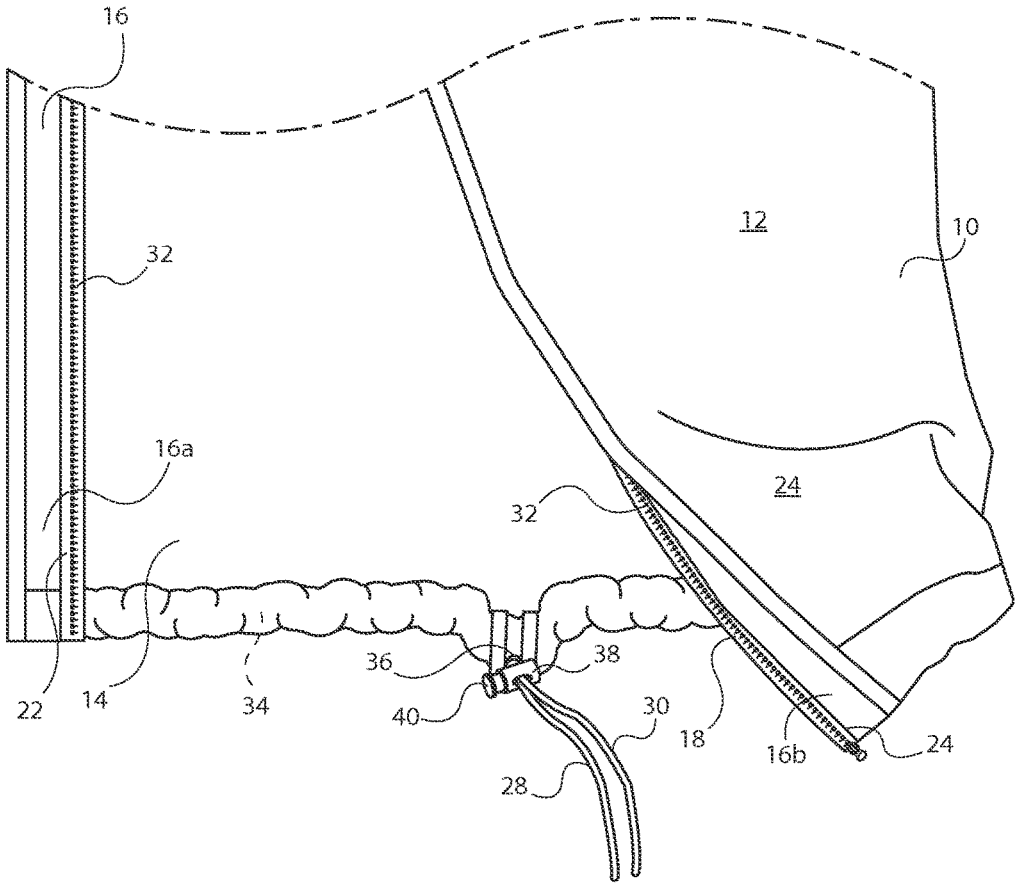
Figure 5:
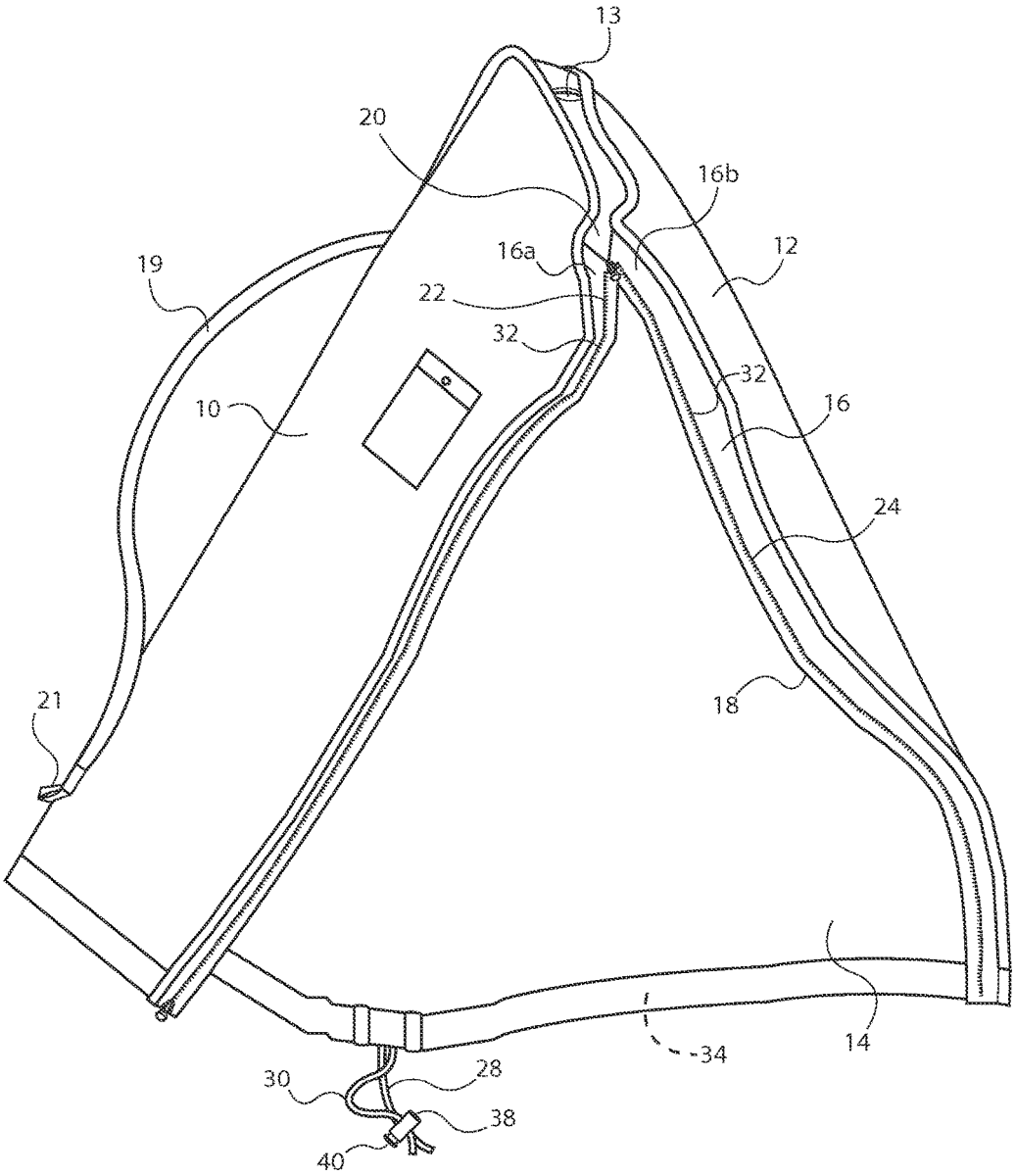

FIG. 4 is a side view of the lower portion of the bag similar to FIG. 2 showing the lower portion of the bag with the combined zipper opening and garment receiving opening; and FIG. 5 is a side view of the entire bag with the zipper in the open position showing the combined side gusset opening and garment receiving entrance forming a single large opening to facilitate the insertion and removal of garments in and out of the body.

DETAILED DESCRIPTION OF THE INVENTION

As seen in the figures, bag 10 of the present invention includes a flexible fabric body 12 defining a compartment adapted to retain garments. Bag 10 is shown in FIGS. 1, 2, 4 and 5 oriented to function as a carrier for dry cleaned garments. Body 12 has a relatively large garment receiving entrance 14 at the lower end, when the bag is oriented for use as a dry cleaning carrier.

Figure 1:
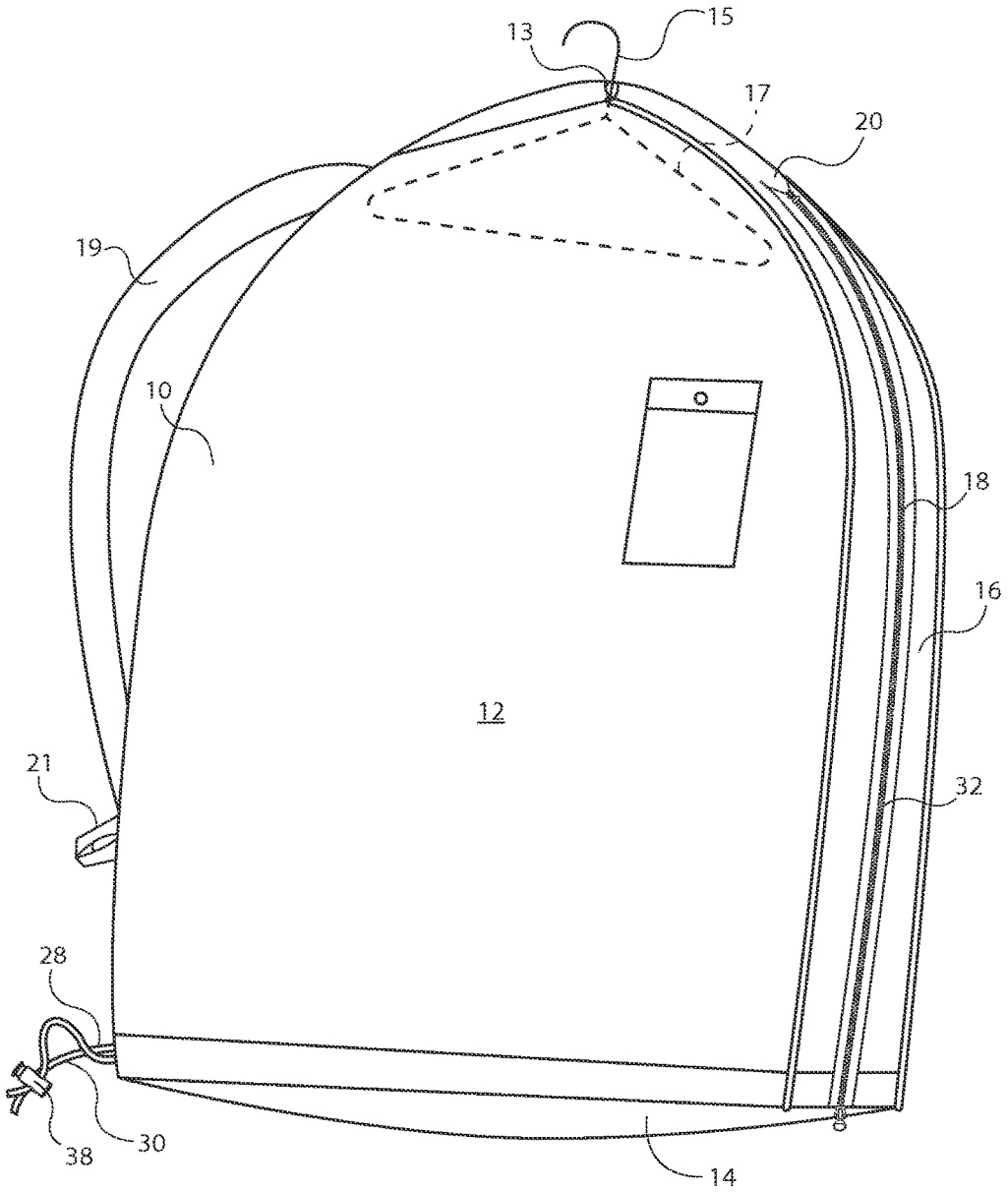
FIG. 1 is a perspective view of the bag of the present invention oriented to function as a carrier for dry cleaned garments.

As seen in FIG. 1, body 12 has a substantially closed end opposite garment receiving entrance 14. A relatively small opening 13 is situated in the closed end. When the bag is used as a dry cleaning carrier, the hook portions 15 of one or more hangers 17 (only one is shown) situated within body 12 extend through opening 13 such that the bag can be suspended from a closet bar or the like. The dry cleaned garments (not shown) are hung from the hangers.

Figure 3:
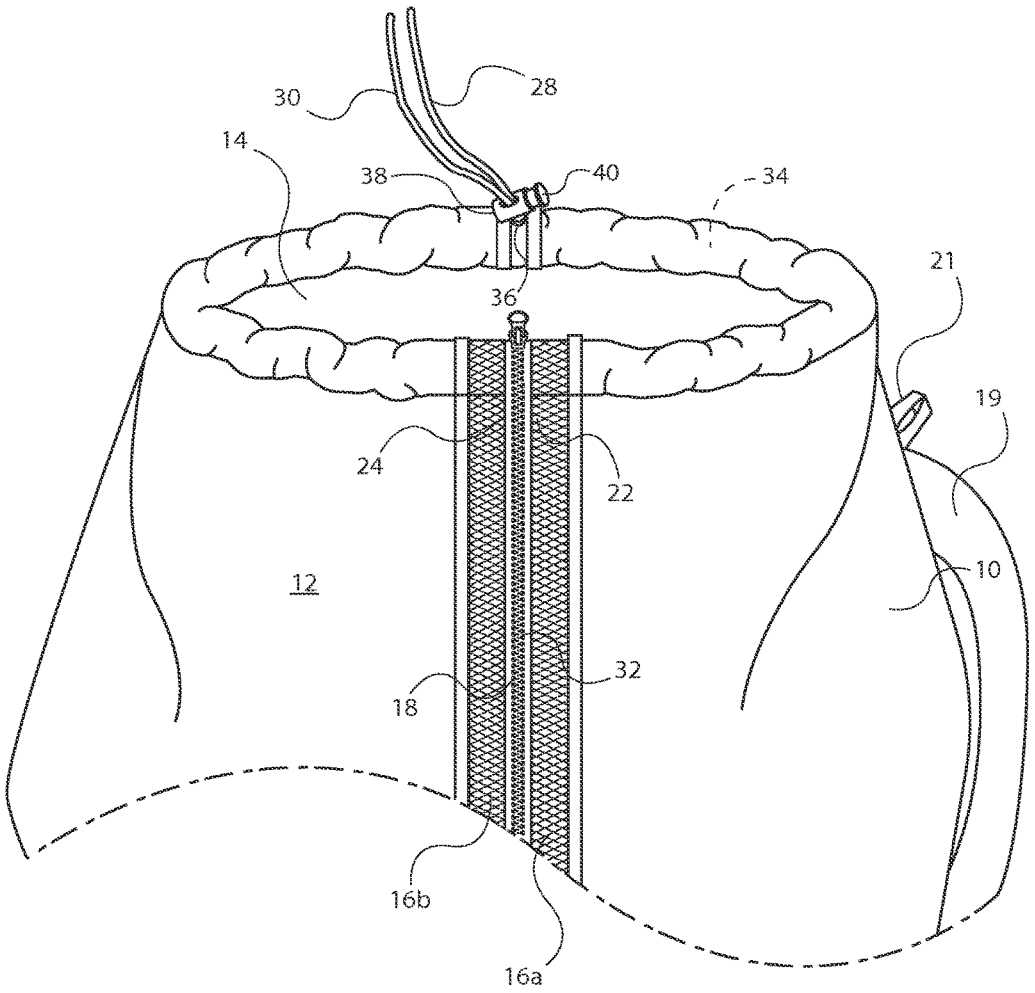
FIG. 3 is a side view of the upper portion of the bag in the laundry bag orientation showing the garment receiving entrance closed by the drawstring.

Body 12 has at least one side. Preferably, the side takes the form of a side gusset 16. As illustrated in FIGS. 2 and 3, the side gusset may be formed of a mesh-like material to allow fresh air to enter the bag.

The bag has a shoulder strap 19 to facilitate transport when the bag is used in the dry cleaning transport orientation. It also has a hanging loop 21 to permit the bag to be suspended from a hook in a closet or the like when in the laundry bag orientation.

An elongated opening 18 in side gusset 16 extends from a point 20 proximate the hanger hook opening 13 all of the way to the garment receiving entrance 14.

Opening 18 is defined by first and second edges 22, 24. Edges 22, 24 extend from point 20 to the garment receiving entrance 14.

A drawstring 26 extends from a location proximate the first side gusset edge 22 to a location proximate the second side gusset edge 24 around the garment receiving entrance. The ends of drawstring 26 are anchored to side gusset 16 at locations on either side of opening 18, proximate the different ones of edges 22, 24.

A zipper 32 is mounted for movement along the side gusset opening 18. The zipper is movable between a closed position, proximate the garment receiving entrance, as shown in FIGS. 1, 2 and 3, wherein the side gusset opening 18 is closed, and an open position proximate point 20 on the side gusset, as shown in FIGS. 4 and 5, wherein the side gusset is open and side opening 18 combines with garment receiving entrance 14 to form a single large opening to facilitate the insertion and removal of garments into and out of the bag body.

Side gusset 16 includes first and second side gusset portions 16*a*, 16*b* located on opposite sides of opening 18. Drawstring 26 preferably includes two drawstring parts 28, 30. As seen in FIG. 2, one end 28*a* of drawstring part 28 is fixed within side gusset 16*a* at a point adjacent to edge 22. Similarly, one end 30*a* of drawstring part 30 is fixed to side gusset portion 16*b* at a point adjacent to edge 24.

The parts 28, 30 of drawstring 26 are situated in a channel 34. Channel 34 has closed ends situated on the opposite sides of opening 18 within side gusset portions 16*a*, 16*b*. The ends 28*a*, 30*a* of drawstring parts 28, 30 terminate at and are fixed in the closed ends of channel 34, respectively.

Channel 34 extends from a point within the lower portion of side gusset portion 16*a* proximate edge 22 to a point within the lower portion of side gusset portion 16*b* proximate edge 24. The ends of drawstring parts 28, 30 are permanently anchored to the closed ends of the channel by stitching or the like. Accordingly, the ends of the drawstring parts are fixed proximate to the opposite edges of the side opening. The side opening intersects the plane which passes through channel 34, is aligned with the space between the ends of side gusset portions 16*a* and 16*b*, and extends into the garment receiving opening 14.

Channel 34 has an opening 36 at a point along the garment receiving opening substantially opposite to side gusset 16. The unattached ends of drawstring parts 28, 30 extend through opening 36 such that the unattached ends of the drawstring parts are exposed and accessible from the outside of the bag.

When the drawstring parts are drawn in a direction away from the bag body, portions of the unattached ends of drawstring parts will withdraw from channel 34 to a limited extent (see FIGS. 2, 3, 4 and 5). That will cause the portion of the bag proximate the garment receiving entrance to bunch up and substantially restrict the size of the garment receiving entrance, as illustrated in FIGS. 3 and 4. This is normally done when the bag is being used as a counter bag, the bag is full of laundry and ready to be collected.

A spring-loaded cylindrically shaped stop 38 is provided. Stop 38 may have a pushbutton 40 mounted on the side thereof. The purpose of stop 38 is to maintain the drawstring parts in the drawn position, keeping garment receiving entrance 14 in the restricted state (FIG. 3), so that no laundry can fall out of the bag as it is transported.

The unattached drawstring end portions are drawn through an opening in stop 38 as the pushbutton 40 is depressed. When the drawstring parts have been drawn sufficiently, pushbutton 40 is released and the stop clamps the drawstrings such that the drawstrings cannot be drawn back into channel 34 through opening 36. That insures that the garment receiving entrance remains in a restricted state.

Zipper 32 can be in any position along opening 18 when the dry cleaned garments are inserted into or removed from the bag. However, the further the pull of the zipper is from the garment receiving entrance 14, the larger the combined side gusset opening/garment receiving entrance will be and hence the easier it will be to insert into and remove garments from the bag.

It should be noted that dry cleaned garments can be inserted into or removed from the interior of the bag of the present invention whether the drawstrings are drawn to restrict the size of the garment receiving entrance, as seen in FIGS. 3 and 4, or the garment receiving entrance is unrestricted, as seen in FIGS. 1, 2 and 5. However, if the size of the garment receiving entrance is not restricted, the combined side gusset opening/garment receiving entrance opening will be larger than if the size of garment receiving entrance is restricted.

It will now be appreciated that the bag of the present invention is convertible to function as a counter bag in a first orientation and a dry cleaning transport carrier in a second orientation. The convertible counter/dry cleaning bag has a side, preferably in the form of a side gusset, with an elongated opening. A zipper is movable along the side opening between a closed position, wherein the opening in the side is closed, and an open position, wherein the opening in the side opening and the garment receiving entrance combine to form a single large opening to facilitate the insertion and removal of garments into and out of the bag.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A convertible counter/dry cleaning bag for use with, a hanger with a hook member, said bag comprising an opening through which the hook member of a hanger may extend at one end thereof and a garment receiving entrance at the other end thereof, a first side including a side gusset, an opening in said side gusset defined by first and second edges and extending from a point on the bag proximate to but spaced from said hook member opening to said garment receiving entrance, a second side having an opening, a drawstring situated adjacent said garment receiving entrance comprising first and second drawstring parts, said first drawstring part extending from a location proximate the first side gusset opening edge with a portion thereof extending through said second side opening, said second drawstring part extending from a location proximate the second side gusset opening edge with a portion thereof extending through said second side opening, such that said portions of said, drawstring parts may be pulled away from said second side to alter the size of said garment receiving entrance, and a zipper movable along the side gusset opening between a closed position, wherein the side gusset opening is closed, and an open position, wherein the side gusset opening and the garment receiving entrance combine to form a single large opening to facilitate the insertion and removal of garments into and out of the bag.

2. The bag of claim 1 wherein the side gusset comprises first and second side gusset portions located on different sides of the side gusset opening and wherein first and second drawstring pails comprises an end, each of said ends being fixed to a different one of the side gusset portions.

3. The bag of claim 1 further comprising a channel through which the drawstring parts extend, wherein the channel comprises first and second closed channel ends.

4. The bag of claim 3 wherein each of said drawstring parts comprises an end, said drawstring part ends being fixed to different ones of the closed channel ends.

5. The bag of claim 1 wherein the bag functions as a counter bag in a first orientation and a dry cleaning transport carrier in a second orientation.

6. The bag of claim 1 further comprising a part said portion of said drawstring parts.

7. The hag of claim 5 wherein the position of said engaging part along said portions of said drawstring parts determines the effective length of said drawstring.

8. The bag of claim 5 wherein the position of said engaging part along said portions of said drawstring parts determines the effective length of said drawstring.

* * * * *